US006699826B1

(12) United States Patent
Saijo et al.

(10) Patent No.: US 6,699,826 B1
(45) **Date of Patent: *Mar. 2, 2004**

(54) SHEET-FORM LAUNDERING ARTICLE

(75) Inventors: Hiroyuki Saijo, Wakayama (JP); Hiromitsu Hayashi, Wakayama (JP); Hirohiko Hanada, Wakayama (JP); Katsuhiko Kasai, Wakayama (JP); Kazutoshi Ide, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/509,081

(22) PCT Filed: Jul. 23, 1999

(86) PCT No.: PCT/JP99/03968

§ 371 (c)(1),
(2), (4) Date: Mar. 22, 2000

(87) PCT Pub. No.: WO00/05335

PCT Pub. Date: Feb. 3, 2000

(30) Foreign Application Priority Data

Jul. 23, 1998 (JP) ..... 10-208441

(51) Int. Cl.[7] ..... C11D 17/04
(52) U.S. Cl. ..... 510/296; 510/438; 510/439
(58) Field of Search ..... 510/296, 438, 510/439

(56) References Cited

U.S. PATENT DOCUMENTS

| | | | | | |
|---|---|---|---|---|---|
| 4,167,561 | A | * | 9/1979 | Lamberti et al. | 424/149 |
| 4,532,063 | A | * | 7/1985 | Gueldenzopf | 252/186.35 |
| 4,557,852 | A | * | 12/1985 | Schulz et al. | 252/186.35 |
| 4,619,779 | A | * | 10/1986 | Hardy | 510/513 |
| 4,654,395 | A | * | 3/1987 | Schulz et al. | 526/318.42 |
| 4,743,394 | A | * | 5/1988 | Kaufmann et al. | 510/296 |
| 4,797,221 | A | * | 1/1989 | Gueldenzopf | 252/186.2 |
| 5,078,301 | A | | 1/1992 | Gladfelter et al. | |
| 5,198,198 | A | | 3/1993 | Gladfelter et al. | |
| 5,202,045 | A | * | 4/1993 | Karpusiewicz et al. | 510/297 |

FOREIGN PATENT DOCUMENTS

| | | | |
|---|---|---|---|
| DE | 34 22 055 | * | 12/1985 |
| EP | 0079712 | | 8/1988 |
| EP | 0 337 568 A2 | | 10/1989 |
| EP | WO 9117202 | | 11/1991 |
| EP | 0 957 158 A1 | | 11/1999 |
| JP | 58-87145 A | | 5/1983 |
| JP | 63008496 A2 | * | 1/1988 |
| JP | 1-240461 | | 9/1989 |
| JP | 04 20 26 00 | * | 7/1992 |
| JP | 5-501091 A | | 3/1993 |
| JP | 10072593 | * | 3/1998 |
| JP | 10072599 A | | 3/1998 |
| JP | 10072599 | * | 3/1998 |
| JP | 1007 2600 | * | 3/1998 |
| JP | 100702599 A2 | * | 3/1998 |
| JP | WO9832835 | | 7/1998 |
| JP | 11124600 A2 | * | 5/1999 |

* cited by examiner

*Primary Examiner*—Lorna M. Douyon
(74) *Attorney, Agent, or Firm*—Birch, Stewart, Kolasch & Birch, LLP

(57) ABSTRACT

An economical sheetlike article for laundry whose flexibility is excellent, of which sprinkling and loss of the content are small and wherein a water-soluble substrate having a low basis weight is used. Thus, the present invention provides a sheetlike article for laundry in which a layer containing at least one composition selected from the group consisting of a detergent composition, a fiber softener composition and a bleaching agent composition, is connected with a water-soluble substrate on the both sides of the said layer, and of which the flexibility parameter calculated by a specific method is from 3 to 6.

12 Claims, 1 Drawing Sheet

(A)

(B)

(C)

SHEET-FORM LAUNDERING ARTICLE

This application is the national phase under 35 U.S.C. §371 of PCT International Application No. PCT/JP99/03968 which has an International filing date of Jul. 23, 1999, which designated the United States of America.

TECHNICAL FIELD

The present invention relates to a sheetlike article for laundry.

BACKGROUND OF THE INVENTION

An article for laundry, which has a sheetlike shape and which comprises a layer containing a detergent composition and comprises a water-soluble substance being arranged on the both sides of the said layer, have been known. In JP-A 10-72599, it is mentioned as a characteristic feature of the said shape that leak of the content can be prevented and that the shape is stable against the shock during transportation and filling of carton etc. However, in the said patent, there is neither specific suggestion nor description at all for the property of the sheetlike article which can be easily handled by hand or for a favorable physical property of the sheetlike article having an excellent stability of the shape against the shock during transportation and the filling.

Under such circumstances, there has been a keen demand for the means for a sheetlike article which satisfies the requirements of both easy handling and stability of shape against shock.

DISCLOSURE OF THE INVENTION

The present invention provides a sheetlike article for laundry, comprising a layer containing at least one composition (hereinafter, which may be referred to as "detergent composition or the like") selected from the group consisting of a detergent composition, a fiber softener composition and a bleaching agent composition, comprising a water-soluble substrate connected with the layer on both sides thereof, and having the flexibility parameter calculated by the following method in the range of from 3 to 6.

(Method for Calculating the Flexibility Parameter)

A sheetlike article for laundry, which has the thickness of h (cm), the length of a (25-fold of h) and the width of b (1.5 cm), is placed on 2 supports where the distance between the supporting points is L (16-fold of h). Then, at the point of L/2 on the said support, a load is applied by descending a tooth-profiled pushing rod at the rate of 2 cm/minute against the direction of width of the said sheetlike article for laundry and, when:the resulting maximum load is determined as F (N), the flexibility parameter is calculated from the following formula.

$$\text{Flexibility parameter}=\log[(3\times F\times L)/(2\times b\times h^2)\times 10^4]$$

Preferably, the detergent composition or the like contains a nonionic surfactant.

It is also preferable that the detergent composition or the like contains a nonionic surfactant (a) and polyalkylene glycol (b) having the flow point of not lower than 40° C., that (a)/(b) is from 99.9/0.1 to 70/30 (by weight) and that (a)+(b) is 3–50% by weight.

Further, it is preferable that the detergent composition or the like contains a nonionic surfactant and an anionic surfactant.

The composition is preferably a detergent composition.

Figure 1:
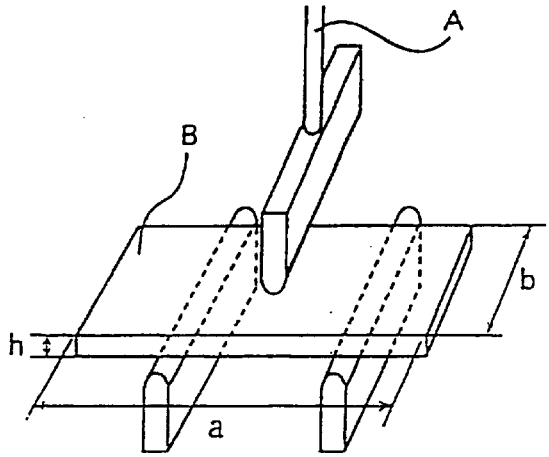
FIG. 1 consists of drawings which show a method for measuring the maximum load F for calculating the flexibility parameter.
Figure 1:
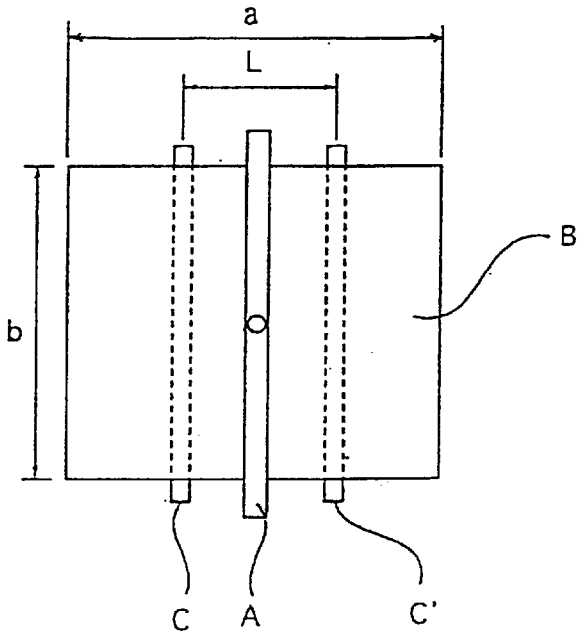
Figure 1:
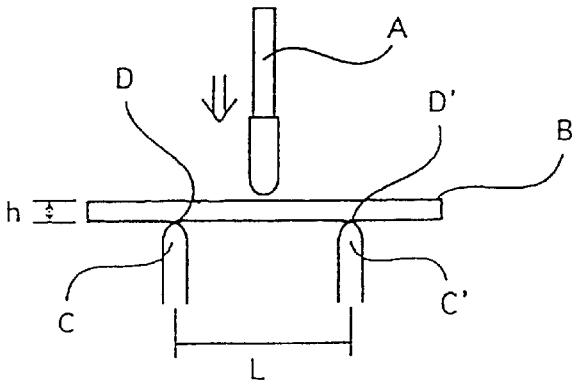

Reference letters used in the drawings are as follows.

A . . . tooth-profiled pushing rod,

B . . . sheetlike article for laundry,

C, C' . . . supports, and

D, D" . . . supporting points.

MODES FOR CARRYING OUT THE INVENTION

FIGS. (A)–(C) are summary drawings for showing how to measure the maximum load F in which A is a tooth-profiled pushing rod, B is a sheetlike article for laundry, C and C' are supports, and D and D' are supporting points. In the measurement, a FUDOH RHEO METER (manufactured by K. K. Rheotech) and an exclusive adapters therefor, i.e., a tooth-profiled pushing rod A (the tooth-profiled pushing rod A for the present measurement) and adapters (the supports C and C' of the present measurement) for folding core JIS (for a folding test) are used. Now, firstly, a sheetlike article for laundry B having the thickness of h (usually 0.05–1.0 cm), the length of a (25-fold of h) and the width of b (1.5 cm) as shown in FIG. 1(A) is prepared and then placed on the 2 supports C and C' where the distance between the supporting points D and D' is L (16-fold of h) in such a manner that the transverse direction of the said sheetlike article for laundry B is parallel to those of the supports C and C' and that the center in the longitudinal direction is made at the position of L/2 [see FIG. 1(B)]. After that, a setting is made in such a manner that the end of the tooth-profiled pushing rod touches at a right angle with the transverse direction of the said sheetlike article for laundry B at the position of L/2 on the said support. Then, a load is applied by descending at the rate of 2 cm/minute [see FIG. 1(C)] and the maximum load applied to the tooth-profiled pushing rod A is measured and is defined as the maximum load F. Alternatively, in that case, the load may be applied by ascending the said supports at the rate of 2 cm/minute. From this maximum load F is calculated the flexibility parameter by the above-mentioned formula. Here, at the end of the tooth-profiled pushing rod A, a tooth-profiled part having the length of 20 mm and the width of 4.4 mm will be touched to the sheetlike article for laundry B and the touching area of the tooth-profiled part has a smooth semi-circular shape. The supports C and C' are the supports for folding cores of JIS S 6005 and their touching area to the sheetlike article for laundry B has a smooth semi-circular shape. Height of the support is 25 mm.

[Detergent Composition]

The detergent composition of the present invention comprises mainly a surfactant and a builder. Examples of the surfactant include an anionic surfactant such as a salt of sulfate of a higher alcohol or an ethylene oxide (hereinafter, abbreviated as "EO") adduct thereto, analkylbenzene sulfonate, a paraffin sulfonate, an α-olefinsulfonate, an α-sulfofatty acid salt, an a-sulfofatty acid alkyl ester salt and a fatty acid salt; a nonionic surfactant such as an EO adduct or EO/propylene oxide (hereinafter, abbreviated as "PO") adduct of a higher alcohol, a fatty acid alkanolamide and an alkylpolyglycoside; an amphoteric surfactant; and a cationic surfactant. Among them, particularly, an amine salt of a linear alkylbenzene sulfonate having $C_{10-14}$ alkyl chain and a amine salt of sulfate of a higher alcohol having 12–18 carbon atoms are preferable in view of detergency and foaming property; a nonionic surfactant is preferable in view of adjustment of the flexibility parameter; and an adduct to an alcohol having 10–16 carbon atoms with 5–10 moles of EO and an adduct to an alcohol having 10–16 carbon atoms with 4–12 moles of EO and 0.1–4 moles of PO (where EO and PO may be either in random polymerization or in block polymerization) are preferable in view of removal of sebum dirt, resistance against hard water and biodegradability. In view of detergency, the amount of the surfactant in the detergent composition is preferably 5–80% by weight, more preferably 20–60% by weight and particularly preferably 30–50% by weight. Use of the nonionic surfactant together with the anionic surfactant is preferable as well and, in that case, the total amount of both surfactants in the detergent composition is preferably 50–100% by weight and particularly preferably 70–100% by weight in view of detergency. The ratio by weight of the nonionic surfactant to the anionic surfactant, i.e. nonionic surfactant/anionic surfactant, is preferably from 100/0 to 10/90 and particularly preferably from 90/10 to 50/50 in view of solubility.

Especially, the said nonionic surfactant together with polyalkylene glycol having the flow point of not lower than 40° C. in view of adjustment of the flexibility parameter is more preferably cited. With regard to the polyalkylene glycol, polyethylene glycol is preferable in view of solubility. The compounding amount of the polyalkylene glycol is preferably 0.3–30% by weight and more preferably 1.5–14% by weight. The ratio of the nonionic surfactant to the polyalkylene glycol, i.e. nonionic surfactant/polyalkylene glycol, is preferably from 98/2 to 70/30 and more preferably from 95/5 to 80/20. Total compounding amount of the nonionic surfactant and the polyalkylene glycol is preferably 3–50% by weight and more preferably 6–30% by weight.

Examples of the builder include an alkaline metal salt such as a sodium or potassium salt of an inorganic builder such as a carbonate, a crystalline or amorphous aluminosilicate, a crystalline or amorphous silicate, a phosphate and a borate and of an organic builder such as a nitrilotriacetate, an ethylenediaminetetraacetate, a tartrate, a citrate and an acrylic acid polymer and copolymer. Among them, a crystalline aluminosilicate is particularly preferable in terms of the sequester-ability for a polyvalent metal ion such as calcium ion and in terms of the oil absorbability to nonionic surfactant. In view of improvement in detergency, the amount of the builder in the detergent composition is preferably 5–70% by weight, more preferably 10–60% by weight and particularly preferably 15–55% by weight.

In view of manufacture of dough-like product having detergency and flexibility, the ratio of the surfactant to the builder, i.e. surfactant/builder, is from 1/5 to 10/1 (by weight), more preferably from 1/3 to 3/1 and particularly preferably from 1/2 to 3/2.

Further, in view of improvement in adjustment of flexibility of the sheetlike article for laundry, the detergent composition of the present invention preferably contains an amine compound of the following formulae (I)–(IV).

(I)

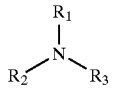

(II)

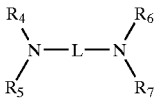

(III)

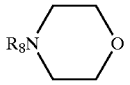

-continued (IV)

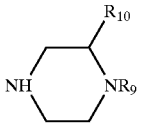

[In the formulae, $R_1$–$R_{10}$ are same as or different from each other and each of $R_1$–$R_{10}$ is a hydrogen atom, a hydrocarbon group which may be substituted by carboxyl group and which has 1–18 carbon atoms, a mono- or polyvalent hydroxyhydrocarbon group having 1–18 carbon atoms, an oxyalkyl group, an —$(EO)_m$—$(PO)_n$H (herein EO and PO may be either in block polymerization or in random polymerization, each of m and n is 0 or more, and m+n is 1 or more) or a COR group (wherein R has the same meaning as $R_1$); L is an alkylene group which may be substituted by an alkyl group having 1–5 carbon atoms and which has 1–12 carbon atoms or a phenylene group; and the case of that all of $R_1$ to $R_3$ are hydrogen atoms is excluded.]

Examples of the amine compound of the formula (I) include an alkanolamine such as monoethanolamine, diethanolamine, triethanolamine, 3-amino-1-propanol, N-β-aminoethylisopropanolamine, N,N-dimethyl(or ethyl, butyl) ethanolamine, N-methyldiethanolamine and N,N-diethylisopropanolamine; an alkylamine such as trimethylamine, triethylamine, 2-ethylhexylamine and sec-butylamine; and an alkoxyamine such as 3-methoxypropylamine and 3-(2-ethylhexyloxy) propylamine. Monoethanolamine, diethanolamine and triethanolamine are particularly preferable in view of economy.

Examples of the amine compound of the formula (II) include a diamine such as N,N,N',N'-tetramethylethylenediamine, 3-(diethyl (or butyl) amino) propylamine, 3-(methylamino) propylamine, 3-(dimethylamino) propylamine, N-hydroxyethyl-N-methyl-1,3-propanediamine, N,N-dihydroxyethyl-N',N'-dimethyl-1,3-propanediamine, N-hydroxyethyl-N',N'-dimethyl-1,3-propanediamine and N,N-dihydroxyethyl-N'-hydroxyethyl-N'-methyl-1,3-propanediamine; and the compound represented by the following formulae (V)–(XI). The amine compound having a hydroxyl group is particularly preferable.

(V)

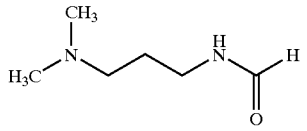

(VI)

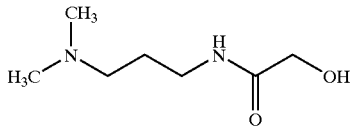

(VII)

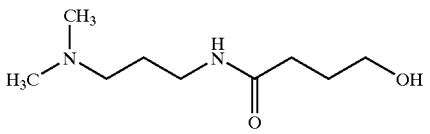

-continued (VIII)

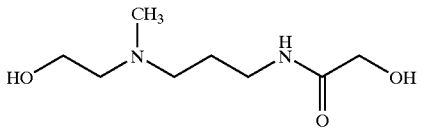

(IX)

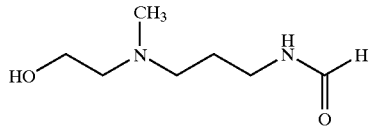

(X)

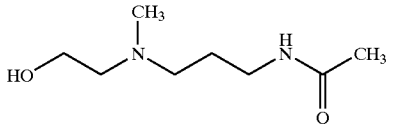

(XI)

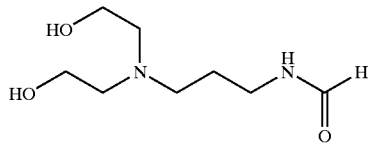

Further, examples of the amine compound represented by the formula (II) include the amine compound represented by the following formula (XII). Specific examples include a diamine such as Tetronic TR 701 (EO in the total molecules is 10% by weight, molecular weight of poly-PO is 2501–3000), Tetronic TR-1501 (EO in the total molecules is 10% by weight, molecular weight of poly-PO is 6501–7000), Tetronic TR-1508 (EO in the total molecules is 80% by weight, molecular weight of poly-PO is 6501–7000) and Tetrnic TR-304 (EO in the total molecules is 40% by weight, molecular weight of poly-PO is 501–1000) which are manufactured by Asahi Denka Kogyo Ltd.

(XII)

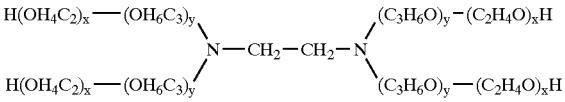

(In the formulae, x is a value which satisfies the requirement that % by weight of EO in the total molecular weight is 10–80% by weight and y is a value which satisfies the requirement that the molecular weight of poly-PO is 500–7000.)

Examples of the amine compound represented by the formula (III) include morpholine, N-methylmorpholine and N-ethylmorpholine, while examples of the amine compound represented by the formula (IV) include piperazine and a hydrate thereof, hydroxyethylpiperazine and 2-methylpiperazine.

The above-mentioned compound represented by (V)–(XI) is preferable in especial view of solubility at low temperature. The above-mentioned amine compound is compounded in the detergent composition preferably in an amount of 1–35% by weight, more preferably 2–20% by weight and still more preferably3–15%byweight. Suchan aminecompoundmaybeused as a counter ion to the anionic surfactant. Especially, when an amine compound is used as a counter ion to the anionic surfactant, the ratio of the total amount of the components (a) and (b) [as (a)+(b)] to the amount of the amine salt of the anionic surfactant (c), i.e. [(a)+(b)](c), is preferably from 85/15 to 10/90, more preferably from 80/20 to 15/85 and still more preferably from 75/25 to 25/75.

The detergent composition in the present invention may further contains a bleaching agent (such as a percarbonate, a perborate and a bleaching activator which will be mentioned later), an antidispertioning agent (such as carboxymethyl cellulose), the following softener, a reductant (such as a sulfite), a fluorescent whitening agent, antifoaming agent (such as silicone) and a perfume which have been publicly known in the art of detergent for clothing. Each of amounts of the bleaching agent and softener in the composition is less than 20% by weight and preferably less than 2% by weight and less than 4% by weight respectively.

[Softener Composition for Fiber]

Examples of the softener for fiber, which can be used in the present invention, include an amine salt and a quaternary ammonium salt. The quaternary ammonium salt of di-long chain-alkyl type is particularly preferable and the alkyl group may contain a connecting group such as —COO—, —OCO—, —NHCO— and —CONH—. The amount of the said softener in the softener composition for fiber is 4–70% by weight. Moreover, a perfume, a dye, a silicone compound, an antibacterial agent, a solvent, a water-soluble salt, etc. may also be contained as an optional component besides the surfactant and builder used for the said detergent composition.

[Bleaching Agent Ccomposition]

With regard to the bleaching agent used in the present invention, a bleaching agent of an oxygen type is suitable for example. The bleaching agent of an oxygen type covers a compound containing a peroxide which generates hydrogen peroxide in water. Examples of such a peroxide include sodium peroxide, an adduct of sodium tripolyphosphate with hydrogen peroxide, an adduct of sodium pyrophosphate with hydrogen peroxide, an adduct of urea with hydrogen peroxide, $4NaSO_4.2H_2O.NaCl$, sodium perborate monohydrate, sodium perborate tetrahydrate, sodium persilicate, sodium peroxide and calcium peroxide. Among them, sodium percarbonate, sodium perborate monohydrate and sodium perborate tetrahydrate are particularly preferable. The amount of the bleaching agent in the bleaching agent composition is 2–90% by weight and preferably 20–90% by weight. If necessary, a compound having an appropriate leaving group, tetraacetylethylenediamine, acetoxybenzenesulfonate, an organic peracid precursor mentioned in JP-A 59-22999, JP-A 63-258447 and JP-A 6-316700, a metal catalyst prepared by stabilizing a transition metal with a sequestering agent for a metal ion, etc. may be contained therein as a bleaching activator. The amount of the bleaching surfactant in the bleaching agent composition is 0–30% by weight and preferably 1–20% by weight. In addition to such surfactant, builder and softener, it is also possible that a solubilizer such as p-toluenesulfonate, xylenesulfonate, alkenylsulccinate and urea; a penetrant; a suspending agent such as clay; an abrasive; a chelating agent; a pigment; a dye; a perfume; etc. are contained therein.

With a view of preventing blocking by dissolution of the water-soluble substrate and also, preventing drying of the detergent composition, the amount of water in the detergent composition or the like of the present invention is preferably 0.1–15% by weight, more preferably 0.5–10% by weight and particularly preferably 2.3–7% by weight, provided that the water of crystallization contained in zeolite, carbonate, citrate, etc., is excluded.

In preparing the layer of a detergent composition or the like of the present invention, it is preferable that the detergent composition, etc. is kneaded to make into a dough-like state. Thus, it is preferable to form a layer containing the said composition or the like from the detergent composition or the like into a dough-like state. When the detergent composition or the like is made into a dough-like state, the penetration hardness at 25° C. is preferably 0.1–20 kg/cm$^2$, more preferably 0.5–15 kg/cm$^2$ and particularly preferably 1.5–10 kg/cm$^2$. Here, the term "dough" means for a kneaded product of the powder composition with a substance having the fluidity such as liquid, paste or gel composition. Incidentally, the substance having the fluidity covers a substance showing fluidity by heat or by applied stress. The penetration hardness is determined in such a manner that an adapter (a circle having the bottom area of 1 cm$^2$) being exclusive for RHEO METER (FUDOH RT-2010J-CW) is pressed at the surface of the detergent composition or the like kept at 25° C. and the stress is measured, when the adapter is penetrated to an extent of 2 cm into the said detergent composition or the like at the penetrating rate of 30 cm/minute. Further, viscosity (as measured by a rotor No.4 of type DVM-B manufactured by TOKIMEC INC., revolution of 3 rpm, 25° C.) of the detergent composition or the like is not less than 100,000 mPa·s and more preferably not less than 200,000 mpa·s.

Unlike a paste-like detergent (usually its viscosity is less than 100,000 mPa—s and penetration hardness is less than 0.1 kg/cm$^2$), the detergent composition or the like being dough-like according to the present invention shows substantially no fluidity because of the above-mentioned characteristics. Therefore, flexibility of the said article for laundry can be improved even when the water-soluble substrate of a low basis weight is used. Incidentally, the layer containing the detergent composition or the like in the present invention may be in a shape other than a dough such as a paste as far as the conditions for the flexibility parameter are satisfied.

Thickness of the layer containing the detergent composition or the like is preferably less than 1 cm, more preferably 0.03–0.8 cm and particularly preferably 0.07–0.5 cm in view of solubility at low temperature and in view of simplicity and convenience.

The dough-like product of the present invention can be manufactured using a universal mixer, kneader, etc. which are suitable for stirring of a highly viscous substance. When polyalkylene glycol having the flow point of 40° C. or higher is added, the dough-like product can be manufactured within a short period.

[Water-soluble Substrate]

The water-soluble substrate of the present invention is connected with both sides of the layer containing the detergent composition or the like and has a function of maintaining the shape of the sheetlike article for laundry.

Examples of the water-soluble substrate of the present invention include (i) a water-soluble film; (ii) a water-soluble nonwoven fabric or woven fabric; (iii) a water-soluble laminated substrate comprising water-soluble filmand the said water-soluble nonwoven fabric or woven fabric; and (iv) a laminated material formed from a water-soluble film and a web comprising awater-soluble fiber. Water-soluble substrate of (i), (ii) and (iv), particularly (iv), is preferable in view of preventing blocking of the sheetlike articles for laundry by moisture in the air and also in view of simplicity and convenience, particularly.

Examples of the water-soluble substrate of the present invention include a water-soluble substrate containing an alkali-resistant water-soluble polymer compound such as polyvinyl alcohol (hereinafter, referred to as "PVA"), polyvinylpyrrolidone, pullulan, polyacrylamide, polyacrylic acid and a salt thereof, polymethacrylic acid and a salt thereof, polyitaconic acid and a salt thereof, polyethylene oxide, polyvinyl methylene ether, xanthane gum, cyamoposis gum (which may be guar gum), collagen, carboxymethyl cellulose, hydroxyethyl cellulose and hydroxypropyl cellulose.

Particularly, preferable one is a partially saponified PVA whose degree of saponification is less than 96% by mole or a saponified anion group-modified PVA whose degree of saponification is not less than 96% by mole, preferably not less than 98% by mole, and whose average degree of polymerizationis250–3000, preferably500–2500. Examples of the monomer having an anionic group include an unsaturated carboxylic acid such as acrylic acid, crotonic acid, maleic acid, fumaric acid and itaconic acid; an unsaturated sulfonic acid such as 2-acrylamide-2-methylpropanesulfonic acid; and an ester or anhydride thereof. Particularly, preferable ones are maleic acid, itaconic acid and 2-acrylamide-2-methylpropanesulfonic acid. Degree of modification of the anionic group is 0.1–8% by mole, preferably 2–5% by mole, as compared with the total amount of the monomer units in whole molecules.

Other examples of the water-soluble substrate in the present invention in view of processing ability, softness, blocking prevention ability and allowance of hydrophilicity include a plasticizer of a polyhydric alcohol type such as ethylene glycol, propylene glycol and glycerol and a water-soluble substrate containing an anionic and/or cationic surfactant.

Thickness of the film of the water-soluble substrate may depend upon the type, characteristic and amount of the detergent composition or the like, but it is preferably 5–200 $\mu$m and particularly preferably 10–100 $\mu$m in view of softness, flexibility, and simplicity and convenience in use. In particular, the basis weight of the water-soluble substrate is preferably not more than 80 g/m$^2$, more preferably 10–80 g/m$^2$, further preferably 15–80 g/m$^2$ and particularly preferably 20–65 g/m$^2$ in view of economy and maintaining the shape as a water-soluble substrate.

Examples of the method for producing the water-soluble laminated substrate include a method where a water-soluble nonwoven fabric or woven fabric is overlapped with a water-soluble film and is adhered by heat seal and a method where a water-soluble nonwoven fabric or woven fabric is overlapped with a water-soluble film applied with the said water-soluble polymer and is adhered.

Then, examples of the laminated material (which may be referred to as "laminated material (iv)" hereinafter) formed from a web comprising the above-mentioned water-soluble fiber (iv) and from a water-soluble film include, at least, a laminated material which is formed from a web comprising a water-soluble PVA fiber having the melting point of 140–220° C. and a water-soluble PVA film having the melting point of 140–220° C. and which has the basis weight of not more than 50 g/m$^2$. With regard to a water-soluble PVA fiber which has the melting point of 140–220° C. and which constitutes the web of the said laminated material (iv), a PVA fiber which is soluble in water at low temperature mentioned, for example, in JP-A 8-118559 is a suitable example. A partially saponified PVA fiber is more preferable in view of solubility after making into a laminated material and in view of economy. The term "partially saponified PVA" means that the degree of saponification is not less than 70% by mole and less than 96% by mole and that the average degree of polymerization is 250–3000 and preferably 500–2500. Such a PVA fiber is wound, crimped and cut, and then the resulting staple is opened with a card or the like whereby a web can be prepared. The water-soluble PVA fiber may be used solely or two or more may be used jointly. Incidentally, web is preferable than nonwoven fabric in view of solubility.

With regard to a water-soluble PVA film having the melting point of 140–220° C. for the said laminated material (iv), various modified PVA films may be used. Particularly, because the solubility in water of the laminated material is not deteriorated even when it is brought into contact with a detergent component or the like after a long preservation of the article for laundry, the contacting surface of the detergent or the like is preferably a completely-saponified PVA film. With regard to the completely-saponified PVA used here, one which has the degree of saponification of not less than 96% by mole and preferably not less than 98% by mole and which is water-soluble may be used. A completely-saponified anionic group-modified PVA which has the degree of polymerization of 250–3000 and preferably 500–2500 is particularly preferable.

Here, the monomer having an anionic group and the degree of modification thereof are the same as the monomer of the partially saponified anionic PVA. But, with regard to the degree of modification thereof, in view of solubility in cold water and resistance against alkali, maleic acid and itaconic acid are preferable and maleic acid is particularly preferable. Degree of modification of anionic group is 0.1–8% by mole and preferably 2–5% by mole as compared with the total amount of the monomer units in whole molecules. The water-soluble PVA film may be used solely or two or more may be used jointly.

In determining the melting point of the above-mentioned fiber and film, a differential scanning calorimeter (manufactured by Mettler, DSC-20) is used. And then, the temperature showing an endothermic peak when the temperature is raised at the rate of 10° C./minute is measured.

The laminated material (iv) is formed at least from a web and a film. For example, a web and a film are overlapped and are pressed with heat in the state, as they are, to adhere the web with film whereby a laminated material (iv) comprising the web with the film can be prepared. Above all, the method for forming the laminated material, which comprises pressing with heat to adhere a web with a film by using a heat-emboss-roll having 10–50% of the preferable ratio of the adherent area to the pressing area, can carry out fixing of a fiber in the web and fixing of whole of the web to film at same time, whereby the method is preferable in view of easiness at the producing step and in view of economy. The above-mentioned method for adhering by pressing with heat is preferable in also view of improving feeling by touching, improving the resistance to solubility against a wet hand, etc. as well as the processing ability, too.

For the laminated material (iv), the other water-soluble polymer such as an alkali-resistant water-soluble polymer including polyvinylpyrrolidone, pullulan, polyacrylamide, polyacrylic acid (and a salt thereof), polymethacrylic acid (and a salt thereof), polyitaconic acid (and a salt thereof), polyethylene oxide, polyvinyl methylene ether, xanthane gum, cyamoposis gum, collagen, carboxymethyl cellulose, hydroxyethyl cellulose and hydroxypropyl cellulose may be used as far as the merit of the present invention is not deteriorated.

Basis weight of the laminated material (iv) is not more than 50 g/m$^2$, preferably 10–50 g/m$^2$ and particularly preferably 30–45 g/m$^2$. In view of solubility in cold water and of the producing cost, the basis weight is preferably not more than 50 g/m$^2$. In view of strength against a wet hand and of processing adaptability, the basis weight is preferably not less than 10 g/m$^2$. Thickness of the film of the laminated material (iv) may depend upon the type, characteristic and amount of the detergent composition, but it is preferably 5–200 $\mu$m and particularly preferably 10–110 $\mu$m in view of softness and in view of simplicity and convenience in use.

It is also preferable that, when the laminated materials (iv) (3 cm×3 cm, 4 sheets) are poured into 1 L of distilled water at 10° C. and mixed with stirring for 8 minutes (the stirring is carried out at 550 rpm using a stirring rod having a full length of 35 mm and a maximum diameter of 7.5 mm), no residue is noted after being sieved through a sieve having a pore size of 125 $\mu$m or amount of the residue to the laminated material is less than 2% by weight. In other words, the solubility of the laminated material in 1 L of water at 10° C. after 8 minutes is preferably 98% or more.

[Sheetlike Article for Laundry]

The sheetlike article for laundry of the present invention comprises a layer containing a detergent composition or the like and the water-soluble substrate which is connected with the both sides of the said layer and has 3–6 of the flexibility parameter as measured by the above-mentioned method. The flexibility parameter is an index for expressing the degree of the flexibility of the sheetlike article for laundry. Therefore, when the flexibility parameter is within the range of 3–6 and more preferably 4–5.5, the article has an excellent flexibility. Accordingly, it is able for the article to exhibit a high filling ability in a package and a prevention of damage during transportation filling and of loss of the content. Incidentally, when the said flexibility parameter exceeds 6, the flexibility of the sheetlike article for laundry lowers. As the result, the damage during transportation filling and also the decrease in solubility are caused and that is not preferable. On the other hand, when the said flexibility parameter is less than 3, the content is unable to be easily taken out from a package-container. The said flexibility parameter is dependent upon the thickness b of the sheetlike article for laundry, the composite ratio of the detergent composition or the like related to the maximum load F, the basis weight of the water-soluble substrate, etc.

The sheetlike article for laundry of the present invention can be obtained, for example, by a method where the above-mentioned dough-like detergent composition or the like is previously made into a sheet-like shape and then a water-soluble substrate is connected with both sides thereof, a method where the above-mentioned dough-like detergent composition or the like is supplied between two or more water-soluble sheets which rotate and move by means of rollers or the like and, at the same time, a compression molding is carried out using a roller, a press machine or the like, and a method where a water-soluble substrate is further connected with both sides of a water-soluble substrate which a dough-like detergent composition or the like is impregnated. Connection of the said detergent composition or the like with the said water-soluble substrate is preferably in such a manner that the whole of a surface is connected, but partial connection may be acceptable so far as the shape and the property of the sheetlike article for laundry are not deteriorated.

In view of solubility or flexibility, thickness of the sheetlike article for laundry is preferably not more than 1 cm, more preferably 0.01–1 cm, still more preferably 0.05–0.8 cm and particularly preferably 0.1–0.5 cm, while the area density is preferably 0.005–1.8 g/cm$^2$ and more preferably 0.02–0.7 g/cm$^2$.

The sheetlike article for laundry of the present invention is preferably made up to arrange an uneveness such as a lattice-like shape and a turtleback-like pattern by means of an emboss-processing etc. in view of solubility and prevention of blocking. Further, an adherent processing by pressing with heat is preferably arranged at the outer circumference in view of prevention of loss of the content, and a broken line-like cutting processing is preferably arranged in view of easiness of tearing.

INDUSTRIAL APPLICABILITY

The sheetlike article for laundry of the present invention has an excellent flexibility and also well prevents the scattering and the loss of the content whereby adjustment of the amount for use is easy. In addition, such merits are maintained even if a water-soluble substrate of a low basis weight is used whereby an economical article for laundry is obtained in the case.

EXAMPLES

Examples 1–6 and Comparative Examples 1–2

Laminated Substrate 1

Water-soluble nonwoven fabric having Metsuke (weight per unit area: basis weight) of 30 g was prepared according to Example 2 of JP-A 8-3848 using an itaconic acid-modified polyvinyl alcohol,(degree of modification: 3.5% by mole) having the average polymerization degree of 1800 and the degree of saponification of 99.5% by mole. In the meanwhile, the same polyvinyl alcohol was used to prepare a 15% by weight aqueous solution containing 2% by weight of glycerol and then made into a water-soluble film having the thickness of 20 $\mu$m by means of a thin-film warm air-drying. The resulting film and water-soluble nonwoven fabric were adhered each other and subjected to a heat embossing treatment to prepare a laminated water-soluble substrate 1. The basis weight of this laminated substrate was 50 g/m$^2$.

Preparation Example 1

The detergent composition comprising the components as shown in Table 1 was charged into Universal Mixer (Model 5DM-03-rmanufactured by Dalton), adjusted at 25° C. and stirred until a homogeneous dough-like detergent composition was prepared. Then a layer having the thickness of 0.15 cm was prepared using a dough sheeter (Econom STM 513 manufactured by SEEWER AG.) followed by cutting into a size of 5×10 cm. The said layer piece was sandwiched between two sheets of the above-mentioned laminated substrate 1, in such a manner that the nonwoven fabric was placed outside, and then the circumference was applied with a heat sealing to prepare a sheetlike article for laundry. The average weight was 10 g and the average area density was 0.2 g/cm$^2$. Flexibility parameter of each of the sheetlike articles for laundry thus obtained is shown in Table 1.

In addition, the degree of prevention of loss of the content from the obtained sheetlike article for laundry and also the shock resistance which was a model for determining the shape-stability during transportation of the said article were measured by the following methods. The result is shown in Table 1.

[Method for Measuring the Degree of Prevention of Loss of the Content]

A half length of the central part of 10 g of the above-mentioned sheetlike article for laundry was cut at the temperature of 20° C. under the relative humidity of 60% and then the article was hung for 30 minutes keeping the cut area downward, therefore the lost amount of the content was measured. When the lost amount was less than 0.5 g, the degree of prevention of loss was evaluated as ○. While, when it was 0.5 g or more, the degree of that was evaluated as X.

[Shock Resistance]

20 sheets of the sheetlike article for laundry were overlapped and filled in a vinyl-plastic bag so that the sheets did not move in the bag, then they were fallen down from the height of 1 m onto a floor made of linoleum and the resulting state was observed.

TABLE 1

| | | Examples | | | | | | Comparative examples | |
|---|---|---|---|---|---|---|---|---|---|
| Compounded components (% by weight) | Notes | 1 | 2 | 3 | 4 | 5 | 6 | 1 | 2 |
| (a) Nonionic surfactant | A | 3 | 8 | 8 | 5 | | 3 | 8 | 15 |
| Nonionic surfactant | B | 2 | 4 | 4 | 3 | | 2 | 4 | 15 |
| Nonionic surfactant | C | | 8 | 8 | 4 | 20 | | 8 | 15 |
| Nonionic surfactant | D | | 8 | 8 | 4 | | | 8 | 15 |
| (b) Polyethylene glycol | E | 1 | 2 | 2 | 1.5 | 1.3 | 1 | 15 | 0.6 |
| Ratio of (a)/(b) by weight | | 83/17 | 93/7 | 93/7 | 91/9 | 94/6 | 83/17 | 65/35 | 99/1 |
| LAS-amine salt (counter ion a) | F | 10 | 3 | | 7 | 15 | 6 | 3 | |
| LAS-amine salt (counter ion b) | F | 10 | 1 | | 5 | | 5 | 1 | |
| LAS-amine salt (counter ion c) | F | 10 | | | 5 | | 4 | | |
| LAS-amine salt (counter ion d) | F | | | | | | 3 | | |
| LAS-amine salt (counter ion e) | F | | | | | | 3 | | |
| LAS-amine salt (counter ion f) | F | | | | | | 3 | | |
| LAS-amine salt (counter ion g) | F | | | | | | 3 | | |
| LAS-amine salt (counter ion h) | F | | | | | | 3 | | |
| Fatty acid salt (counter ion a) | G | 1 | 1 | | 1 | | 0.5 | 1 | |
| Fatty acid salt (counter ion c) | G | | | | | | 0.5 | | |
| Fatty acid salt (counter ion f) | G | | | | | | 0.5 | | |
| Fatty acid salt (counter ion g) | G | | | | | | 0.5 | | |
| Fatty acid salt (counter ion h) | G | | | | | | 0.5 | | |
| Sulfate salt | H | 2 | 6 | 2 | 4 | | 2 | 6 | |
| Sulfate salt | I | 2 | | | 1 | | 2 | | |
| LAS-Na salt | J | 2 | | | 1 | | 2 | | |

TABLE 1-continued

| Compounded components (% by weight) | Notes | Examples 1 | 2 | 3 | 4 | 5 | 6 | Comparative examples 1 | 2 |
|---|---|---|---|---|---|---|---|---|---|
| Crystalline aluminosilicate | K | 24 | 20 | 36 | 22 | 30 | 24 | 20 | 10 |
| Amorphous aluminosilicate | L | | | | 2 | 2 | | | |
| Sodium carbonate | | 13 | 11 | 15 | 13 | 12 | 13 | 11 | 12 |
| Sodium methsilicate | | 1 | 1 | | 1 | | 1 | 1 | 1 |
| Crystalline sodium silicate | M | 7 | 8 | 5 | 8 | 5 | 7 | 8 | 10 |
| Sodium polyacrylate | N | 3 | 1.5 | 2.5 | 2 | 2 | 3 | 1.5 | |
| Na salt of acrylic acid-maleic acid copolymer | O | 3 | 1.5 | 2.5 | 2 | 3 | 3 | 1.5 | |
| Common component | P | Balance | Balance | Balance | Balance | Balance | Balance | Balance | Balance |
| Water content | | 3 | 2 | 2 | 2.5 | 2.2 | 3 | 2 | 2 |
| Flexibility parameter | | 5.0 | 4.0 | 5.2 | 4.6 | 5.1 | 4.7 | 6.6 | 2.1 |
| Degree of prevention of loss | | ○ | ○ | ○ | ○ | ○ | ○ | ○ | x |
| Shock resistance | | No change | No change | No change | No change | No change | No change | Damaged | No change |

(Note) In the test of Shock resistance, breakage was generated in the detergent composition layer of 3 sheetlike articles for laundry for Comparative Example 1.

Signs used in Table 1 have the following meanings.

A: adduct to lauryl alcohol with 6 moles on average of EO

B: adduct to secondary alcohol having 12–14 carbon atoms with 7 moles on average of EO (Softanol 70 manufactured by Nippon Shokubai)

C: block adduct to the mixture of alcohols having 12 and 14 carbon atoms (at the ratio of 4:1 by weight) with 3 moles on average of EO, 2 moles on average of Po and 3 moles on average of EO D: adduct to the mixture of alcohols having 12 and 13 carbon atoms (at the ratio of 1:1 by weight) with 6.5 moles on average of EO (Nonidet manufactured by Mitsubishi Chemical)

E: molecular weight of about 6000, flow point of 60° C.

F: amine salt of linear alkyl benzenesulfonic acid having $C_{10-13}$ alkyl group G: amine salt of fatty acid having 10–18 carbon atoms H: monoethanolamine salt of sulfate of the mixture alcohols having 12, 14 and 16 carbon atoms (at the ratio of 1:1:1 by weight)

I: monoethanolamine salt of sulfate of adduct to alcohol having 12–15 carbon atoms with 2 moles on average of EO J: sodium salt of linear alkyl benzenesulfonic acid having $C_{10-13}$ alkyl group K: synthetic zeolite (Toyobuilder manufactured by Tosoh)

L: Tixolex 25 manufactured by Rhodia

M: SKS-6 manufactured by Clariant Japan

N: Sokalan PA40 manufactured by BASF

O: Sokalan CP5 manufactured by BASF

P: mixture of 1% of enzyme mixture [of Savinase 18.0T Type White, Lipolase 100T, Celluzyme 0.1T and Termamyl 60T (all manufactured by Novo Nordisk) at the ratio of 1:1:1 by weight], 0.5% of fluorescent dye mixture [of Whitex SA (manufactured by Sumitomo Chemical) and Cinopal CBS (manufactured by Ciba-Geigy) at the ratio of 1:1 by weight], 1% of sodium sulfite, 0.25% of aminoalkyl-modified silicone oil, 0.25% of perfume and the balance for whole amount being made to 100% of Glauber's salt Counter ions are as follows.

a: monoethanolamine b: diethanolamine c: a compound represented by the formula (XI)

d: N-hydroxyethyl-N-methyl-1,3-propanediamine e: N-hydroxyethyl-N',N'-dimethyl-1,3-propanediamine f: a compound represented by the formula (V)

g: a compound represented by the formula (IX)

h: a compound represented by the formula (X)

Examples 7, 8

Laminated Substrate 2

On a film (thickness of 20 μm, basis weight of 26 g/m$^2$) of maleic acid-modified polyvinyl alcohol (degree of modification of 2% by mole) containing 10% of glycerol as a plasticizer and having the degree of polymerization of 1700 and the degree of saponification of 97% was overlapped a web of basis weight of 14 g/m$^2$prepared by opening a fiber (2 deniers, 51 mm length) comprising the said maleic acid-modified polyvinyl alcohol. And then the resulting product was pressed with heat to adhere by an emboss roller equipped a rectangular handle having 25% of the ratio of the adherent area to the pressing area (the line thickness of 30 kg/cm, 120° C.). Basis weight of the obtained laminated substrate 2 was 40 g/cm$^2$.

Preparation Example 2

A 50% aqueous slurry containing 32% by weight of zeolite, 8.6% by weight of sodium carbonate, 4.3% by weight of Glauber's salt, 0.4% by weight of sodium sulfite, 4.3% by weight of sodium polyacrylate and 0.3% by weight of a fluorescent dye was dried by means of a spray drying to obtain dried particles (a) (average particle size: 250 μm). The water content was 5% by weight.

Into a batch kneader (type 1600-65CVJA-3.7 manufactured by Satake Kagaku Kikai) having the capacity of 50 L were placed 7.5 kg of nonionic surfactant and 0.15 kg of PEG. The resultant mixture was mixed with warming at 65° C. until the said PEG was melted and became homogeneous. After that, 1.40 kg of alkylbenzenesulfonic acid, 0.51 kg of water and 0.36 kg of a 48% aqueous solution of NaOH were gradually added thereto at the same time with stirring and then a stirring further was continued for 10 minutes whereby a neutralization reaction was fully carried out. After completion of the reaction, 1.5 kg of AS-Na powder and 18.27 kg of the dried particles (a) were added and the resultant mixture was mixed for about 5 minutes until it became homogeneous and further mixed for 2 minutes after adding 0.3 kg of an enzyme and 0.15 kg of a perfume whereupon a detergent composition shown in Example 7 of Table 2 was obtained.

Next, the laminated substrate 2 cut out in a suitable size was put on a flat stand, in such a manner that a web layer was downside. Then, a molding frame made of a resin plate with the thickness of 2mm having a rectangular hollow of 5×10 cm was set thereon. The detergent composition obtained in Preparation example 2 was quickly pushed into the hollow of the mold frame, the surface was scraped with a spatula to make the composition flat and allowed to stand still for a while and the mold was carefully removed therefrom preventing the deformation of the detergent composition filled in the mold.

Another piece of the laminated substrate 2 together with the above-mentioned laminated substrate were made, in such state that they sandwiched the detergent composition keeping the web outside, the 4 sides of the circumference of the detergent composition were sealed with heat leaving about 3 mm of sealing margin and an excessive part of laminated substrate was cut off.

The obtained sheetlike article for laundry had the average weight of 10 g and the average area density of 0.2 g/cm$^2$. Result of evaluation of flexibility parameter and shock resistance of each of the obtained sheetlike articles for laundry is shown in Table 2.

Example 8

Preparation Example 3

Into a batch kneader (manufactured by Satake Kikai Kogyo, type 1600-65CVJA-3.7) having the capacity of 50 L were placed 9.6 kg of nonionic surfactant and 0.15 kg of PEG. The resultant mixture was mixed by warming at 65° C. until the said PEG was melted and became homogeneous. After that, 1.83 kg of alkylbenzenesulfonic acid and 0.47 kg of a 48% aqueous solution of NaOH were gradually added thereto at the same time with stirring. And then, a stirring was further continued for 10 minutes whereby a neutralization reaction was fully carried out. After completion of there action, 1.95 kg of AS—Na powder, 8.52 kg of zeolite, 2.16 kg of sodium carbonate powder, 1.26 kg of anhydrous Glauber's salt powder, 1.26 kg of AA/MA powder, 0.12 kg of a fluorescent dye, 0.3 kg of an enzyme, 1.18 g of an additional water and 0.15 kg of perfume were added and the resultant mixture was mixed for about 15 minutes until it became homogeneous whereupon a paste-like composition shown in Example 8 of Table 2 was obtained.

A detergent composition layer was formed on the laminated substrate by the same manner as in the Preparation example 2 for the sheet. Then, each 0.2 g of PC particles and AC particles were homogeneously sprayed on the said layer and preparation of the sheet was completed by the same manner as mentioned in the Preparation example 2 for the sheet.

The obtained sheetlike article for laundry had the average weight of 10 g and the average area density of 0.2 g/cm$^2$. Result of evaluation of the flexibility parameter and the shock resistance of each of the obtained sheetlike articles for laundry is shown in Table 2.

TABLE 2

| | Notes | Examples 7 | Examples 8 |
|---|---|---|---|
| Nonionic surfactant (a) | A | 25.0 | — |
| Nonionic surfactant (b) | B | — | 32.0 |
| LAS-Na | C | 5.0 | 6.5 |
| AS-Na | D | 5.0 | 6.5 |
| PEG | E | 0.5 | 0.5 |
| Zeolite | F | 37.0 | 28.4 |
| Sodium carbonate | — | 10.0 | 7.2 |
| Glauber's salt | — | 5.0 | 4.2 |
| Sodium sulfite | — | 0.5 | — |
| Sodium polyacrylate | G | 5.0 | — |
| PC | H | — | 2.0 |
| AC | I | — | 2.0 |
| AA/MA | J | — | 4.2 |
| Fluorescent dye | K | 0.4 | 0.4 |
| Enzyme | L | 1.0 | 1.0 |
| Water content | — | 5.6 | 5.1 |
| Perfume (and others) | — | 0.5 | 0.5 |
| Total (parts by weight) | | 100.5 | 100.5 |
| Flexibility parameter | | 5.4 | 5.1 |
| Shock resistance | | No change | No change |

(Note) Signs used in Table 2 have the following meanings.

A: a product prepared by adding PO(2) to an adduct to $C_{12-14}$ alcohol with 3.3 moles on average of EO (manufactured by Nippon Shokubai, the tradename of Softanol 33) and then adding EO(4) thereto B: an adduct to $C_{12-14}$ alcohol (manufactured by Kao corporation, the tradename of Kalcohl 2475) with 8 moles on average of EO C: a neutralized product of an alkylbenzenesulfonic acid (manufactured by Nisseki Senzai K.K., the trdename of Alken L) having $C_{10-14}$ alkyl group with a 48% aqueous solution of NaOH D: powder of sodium salt of $C_{12-14}$ alkyl sulfate (manufactured by Kao corporation, the tradename of Emal 10P)

E: average molecular weight of about 8500 (manufactured by Kao corporation, the tradename of K-PEG 6000)

F: powder of crystalline sodium aluminosilicate A having the pore size of 4 Å (manufactured by Tosoh, the tradename of Toyobuilder)

G: average molecular weight of about 20000

H: sodium percarbonate (manufactured by Mitsubishi Gas Chemical, the tradename of SPC-D) having the average particle size of about 900 $\mu$m I: extruded granules comprising 51% by weight of a compound represented by the formula

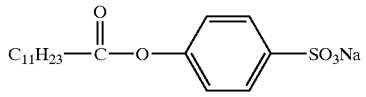

32% by weight of AS-Na powder, 11% by weight of PEG 8000 and 6% by weight of powdery succinic acid (Example 2 of JP-A 8-3592)

J: a copolymer of acrylic acid with maleic acid (manufactured by BASF, Sokalan CP-5)

K: a mixture of Whitex SA as the tradename manufactured by Sumitomo Chemical and Chinopal CBS-X as the tradename manufactured by Ciba-Geigy at the ratio of 1:1 (by weight)

L: a mixture of Savinase 18.0T Type White, Lipolase 100T, Cellzyme 0.1T and Termamyl 60T, all manufactured by Novo Nordisk, at the ratio of 1:1:1:1 (by weight)

Example 9

Preparation Example 4

Each 20 g of the cationic surfactants shown in Table 3, 10 g of oil, 7 g of a nonionic surfactant, 20 g of PEG, 1 g of silicone and 2 g of a perfume were mixed in a cooking cutter. The obtained dough-like product was spread with pressure using a dough sheeter (Econom STM 513 manufactured by SEEWER AG.) to prepare a layer having the thickness of 0.17 cm. The said layer piece cut into a rectangular shape of 5 cm×10 cm was sandwiched with two sheets of the laminated substrate 2, in such a manner that the web was placed outside and then heat sealing was applied to the circumference to obtain a sheetlike article for laundry as shown in Example 9 of Table 3. The obtained sheetlike article for laundry has the average weight of 10 g and the average area density of 0.2 g/cm$^2$. Result of the evaluation is shown in the Table.

TABLE 3

| | Notes | Examples 9 |
|---|---|---|
| Cationic surfactant | A | 20.0 |
| Cationic surfactant | B | 20.0 |
| Cationic surfactant | C | 20.0 |
| Oil | D | 10.0 |
| Nonionic surfactant | E | 7.0 |
| PEG | F | 20.0 |
| Silicone | G | 1.0 |
| Perfume | — | 2.0 |
| Total (parts by weight) | | 100.0 |
| Flexibility parameter | | 5.9 |
| Shock resistance | | No change |

(Note) Signs used in Table 3 have the following meanings.

A: powder of dialkyldimethylammonium chloride (manufactured by Kao Corporation, the tradename of Quartamin D-86-P)

B: a compound represented by the following formula

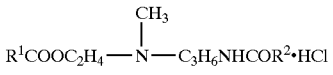

(※: $R^1$ and $R^2$ are alkyl residues derived from a mixture of $C_{16-18}$ fatty acids)

C: a compound represented by the following formula

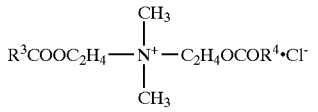

(※: $R^3$ and $R^4$ are alkyl residues derived from a mixture of $C_{16-18}$ fatty acids)

D: glycerol monooleate (manufactured by Kao Corporation, the tradename of Emasol MO-50)

E: polyoxyethylene (12) lauryl ether (manufactured by Kao, the tradename of Emulgen 120)

F: average molecular weight of about 400, manufactured by Wako Pure Chemicals Industries G: ether-modified silicone (manufactured by Toray Dow Corning Silicone, the tradename of SH3748)

What is claimed is:

1. A laundry article sheet, comprising a layer containing at least one detergent composition, which contains a nonionic surfactant (a) wherein the nonionic surfactant is an EO adduct or EO/propylene oxide adduct of a higher alcohol, a fatty acid alkanolamide, and an alkylpolyglycoside; and polyalkylene glycol (b) having a flow point of not lower than 40° C., and provided that the weight ratio (a)/(b) is from 99.9/0.1 to 70/30 and that (a)+(b) is 3–50% by weight, a water-soluble substrate connected with said layer on both sides thereof, and having a flexibility parameter calculated by the following method in the range of from 3 to 6;

the flexibility parameter is calculated by placing a portion of the laundry article sheet having a thickness of h (cm), a length of a (25-fold of h) and a width of b (1.5 cm) on 2 supports, the distance between the supporting points being L (16-fold of h), descending, at the point of L/2 of the supports, a tooth-profiled pushing rod at the rate of 2 cm/minute against the width of the laundry article sheet to apply a load thereon, and calculating the flexibility parameter by the following formula, the resulting maximum load being F(N):

$$\text{Flexibility parameter}=\log\{(3\times F\times L)/(2\times b\times h^2)\times 10^4\}$$

and a thickness of the article laundry sheet is 1 cm or less and has a surface area density of 0.02 to 0.7 g/cm$^2$.

2. The laundry article sheet as claimed in claim 1, wherein said at least one detergent composition contains said nonionic surfactant and an anionic surfactant.

3. The laundry article sheet of claim 1, wherein said at least one detergent composition comprises the nonionic surfactant and optionally anionic surfactant at a weight ratio ranging from 100/0 to 10/90.

4. The laundry article sheet of claim 2, wherein the detergent composition comprises the nonionic surfactant and the anionic surfactant at a weight ratio ranging from 90/10 to 50/50.

5. The laundry article sheet of claim 2, wherein the nonionic surfactant is selected from the group consisting of (i) an adduct of an alcohol having 10 to 16 carbon atoms with 5 to 10 moles of ethylene oxide and (ii) an adduct of an alcohol having 10 to 16 carbon atoms with 4 to 12 moles of ethylene oxide and 0.1 to 4 moles of propylene oxide.

6. The laundry article sheet of claim 1, wherein the sheet has a flexibility parameter of 4 to 5.5.

7. The laundry article sheet of claim 1, wherein the nonionic surfactant is an EO adduct having 10–16 carbon atoms with 5–10 moles of EO or an adduct to an alcohol having 10–16 carbon atoms with 4–12 moles of EO and 0.1–4 moles of PO.

8. The laundry article sheet of claim 1, wherein the polyalkylene glycol is polyethylene glycol.

9. The article laundry sheet of claim 1, wherein the layer containing at least one detergent composition also contains 2.3 to 7 weight percent water.

10. The article laundry sheet of claim 1, wherein the layer containing at least one detergent composition also contains 0.1 to 15 weight percent water.

11. The article laundry sheet of claim 1, wherein the layer containing at least one detergent composition also contains 0.5 to 10 weight percent water.

12. The laundry article sheet of claim 1, wherein the detergent composition has a viscosity of 200,000 mPa·s or more.

* * * * *